US008414147B2

(12) United States Patent
Thrailkill

(10) Patent No.: US 8,414,147 B2
(45) Date of Patent: Apr. 9, 2013

(54) SOLID STATE LIGHTING DEVICE

(76) Inventor: John E. Thrailkill, Shelburne, VT (US)

( * ) Notice: Subject to any disclaimer, the term of this patent is extended or adjusted under 35 U.S.C. 154(b) by 382 days.

(21) Appl. No.: 12/785,602

(22) Filed: May 24, 2010

(65) Prior Publication Data

US 2011/0285288 A1 Nov. 24, 2011

(51) Int. Cl.
*F21V 1/00* (2006.01)

(52) U.S. Cl. ..... 362/235; 362/249.02; 362/246; 362/311.02

(58) Field of Classification Search ..... 362/235, 362/231, 249.02–249.06, 246, 410, 412, 362/417, 311.02, 335
See application file for complete search history.

(56) References Cited

U.S. PATENT DOCUMENTS

| | | | | |
|---|---|---|---|---|
| 6,626,557 | B1 * | 9/2003 | Taylor | 362/235 |
| 7,111,961 | B2 * | 9/2006 | Trenchard et al. | 362/235 |
| 7,255,457 | B2 * | 8/2007 | Ducharme et al. | 362/231 |
| 7,288,902 | B1 | 10/2007 | Melanson | |
| 7,815,338 | B2 * | 10/2010 | Siemiet et al. | 362/218 |
| 2010/0134047 | A1 * | 6/2010 | Hasnain | 315/302 |
| 2011/0141729 | A1 * | 6/2011 | Yang et al. | 362/235 |

FOREIGN PATENT DOCUMENTS

EP 1 705 421 A2 9/2006

* cited by examiner

*Primary Examiner* — Bao Q Truong
(74) *Attorney, Agent, or Firm* — Cesari and McKenna, LLP

(57) ABSTRACT

A solid state lighting device includes a thermally conductive plate having a subassembly mounted to at least one side of the plate. Each subassembly includes a mounting frame with a back side and an open center, and a PCB supporting a plurality of LEDs with electrical leads extending therefrom. The PCB is supported by the frame so that the back of the PCB is flush with the back side of the frame. A cup-like light diffuser having a rim is secured to the front of the frame so that it surrounds the frame and covers the LEDs. Fastening devices fasten the subassembly against the one side of the plate so that the back of the PCB is in intimate thermal contact with the plate and the diffuser rim abuts the plate so that when the LEDs are energized via their leads, a maximum amount of light from the LEDs is directed through the diffuser and waste heat from the LEDs is efficiently conducted away by the plate which may also constitute a reflector.

30 Claims, 13 Drawing Sheets

SOLID STATE LIGHTING DEVICE

BACKGROUND OF THE INVENTION

The present invention relates generally to a solid state lighting device or source of the general purpose type. In particular, the invention relates to such a device which comprises a component system incorporating a plurality of light emitting diodes (LEDs) in order to simulate general purpose incandescent lighting devices.

The present invention further concerns lighting fixtures that incorporate the aforementioned component system in either a single sided or double sided (opposed) configuration.

General purpose LED lighting devices are used primarily in residential and commercial office settings. LED light sources, as well as compact fluorescent (CFL) and linear fluorescent light sources, are generally recognized as the likely replacements for incandescent lighting due to regulatory phase-out of the latter in the years ahead.

Incandescent lighting remains the most popular general purpose lighting technology due to its low initial purchase price and the high quality of its light output. Incandescent bulbs sell for pennies and they provide a diffuse source of broad spectrum illumination that renders colors accurately. In addition, they are capable of task-type lighting at higher power settings, yet can be dimmed down to create very "warm" effect-type lighting at lower power settings. Incandescent lighting remains popular despite the high cost of ownership due to low efficiency and short product life span, especially when the lighting is cycled on and off frequently.

Fluorescent lighting technology is the most popular alternative to incandescent lighting due to a reasonably low initial purchase price, high efficiency, highly diffuse light output and at least the perception of long bulb life. As with incandescent sources, however, life span is greatly reduced when the bulbs are cycled on and off frequently. Fluorescent lighting also suffers from what is generally considered an unnatural quality of light output. Also, dimming a fluorescent product is problematic in that only certain types can be dimmed and then only over a narrow output range. Further, fluorescent products are not capable of spectrally "warming up" at lower power input levels and may even "cool down", creating an even more unnatural effect. In addition, toxic materials employed in the manufacture of the fluorescent devices require a special disposal process that is often ignored, leading to environmental damage.

LED lighting technology offers the promise of high efficacy, long life and benign environmental impact. Increasingly, the technology is providing high quality spectral output with good color rendering ability. However, the current state of the art has a number of major shortcomings. For example, LEDs are directional light emitters. The high degree of secondary diffusion required to create "soft", diffuse lighting effects can greatly reduce the overall efficiency of an LED lighting fixture. LEDs also produce very stable spectral output with respect to input power. While this is beneficial for a number of technical applications, the LEDs cannot be dimmed to produce the warmer light output that many consumers prefer for general lighting. Lastly, LEDs can only dissipate waste heat through the process of thermal conduction. Unfortunately, most lighting fixtures have been designed for incandescent light sources where radiation is the primary mode of waste heat dissipation. Resultantly, the life span of LEDs in a conventional lighting device can be reduced greatly because of this mismatch in thermal dissipation modes.

SUMMARY OF THE INVENTION

It is, therefore, an object of the present invention to provide a high efficiency LED lighting device or source which emulates the lighting characteristics of an incandescent light source.

Another object of the invention is to provide a solid state lighting device that can emit diffuse light whose color temperature may be varied.

A further object of the invention is to provide a LED lighting device consisting of a component system which simultaneously reflects light emitted by the LEDs and efficiently dissipates the waste heat produced thereby.

Still another object of the invention is to provide such a light source which is relatively easy to make and to assemble.

A further object is to provide a LED light source of this type which can be incorporated into a variety of different lighting fixtures.

Another object of the invention is to provide a modular light fixture composed of a plurality of such solid state light sources.

Still another object of the invention is to provide a LED light source having the form of a bulb that can be screwed into a standard lamp socket.

Other objects will, in part, be obvious and will, in part, appear hereinafter.

The invention accordingly comprises the features of construction, combination of elements and arrangement of parts which will be exemplified in the construction set forth hereinafter, and the scope of the invention will be indicated in the claims.

Briefly, my solid state lighting device comprises a component system that includes a plurality of LEDs, at least one photonic diffuser, combined with a relatively thin metallic structure in such a way as to efficiently dissipate waste heat from the LEDs and reflect the light emitted therefrom. The LEDs are powered by a drive circuit, which may be a multichannel version, so that the light from the device may emulate that from a conventional incandescent bulb.

In the component system to be described, the LEDs are located on one side of a small printed circuit board (PCB), along with electrical leads to the LEDs, the opposite or back side of the PCB being substantially flat. The PCB is supported by a mounting frame having opposite first and second sides and an open center so that the back side of the PCB is more or less flush with the first side of the frame and the LEDs are opposite the open center. A cup-like light diffuser having a rim is secured to second side of the mounting frame so that the diffuser surrounds the frame and covers the LEDs. A cable may be provided which has one end connected electrically to appropriate leads on the PCB and a second end located beyond the frame for connection to a power source to activate the LEDs.

According to the invention, the aforesaid PCB, mounting frame and diffuser constitute a subassembly which may be fastened to one side of a relatively rigid, thermally conductive, reflective plate so that the back side of the substrate is in intimate thermal contact with the plate and the diffuser rim abuts the plate. Resultantly, when the LEDs are activated, a maximum amount of light from the LEDs issues from the source while waste heat from the LEDs is efficiently conducted away by the plate.

As we shall see, the aforesaid plate, which functions both as a heat sink and as a reflector, may be flat or have a variety of different shapes to direct or distribute the light from the LEDs in various ways depending upon the particular application. Also, a plurality of the subassemblies may be combined in different ways to provide a variety of different lighting effects.

Preferably also, the plurality of LEDs in the light source or device includes LEDs having different color temperatures so that the LEDs may be mixed and separately controlled so that the source may emit light which emulates that from a standard incandescent bulb which most people seem to prefer and which can be dimmed in a similar way to the light from such a bulb.

BRIEF DESCRIPTION OF THE DRAWINGS

For a fuller understanding of the nature and objects of the invention, reference should be made to the following detailed description taken in connection with the accompanying drawings, in which.

DESCRIPTION OF THE PREFERRED EMBODIMENTS

Figure 1:
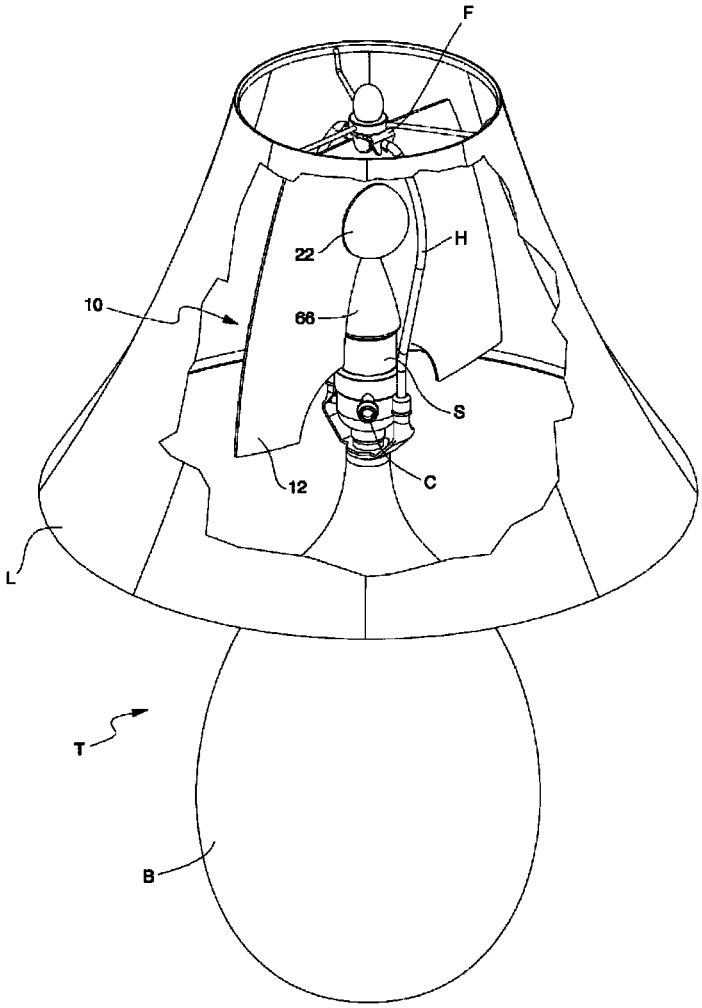
FIG. 1 is a perspective view with parts broken away showing a table lamp incorporating a two-sided lighting device according to the invention.

Refer now to FIG. 1 of the drawings which shows generally at 10 a two-sided solid state lighting device or source according to the invention incorporated into a table lamp T. Lamp T has a base B which may support a conventional switchable socket S whose switching control C extends from the side of the socket. A conventional harp H is mounted to the top of base B just below the socket and extends up and around device 10 so that it can support a lampshade L. For convenience, we will refer to device 10 in this lamp context as a "bulb" because it can be turned on and off like a regular incandescent bulb by operating the switch control C. Also, by separating harp H with shade L from socket S in the usual way, the bulb 10 can be screwed into socket S like a conventional incandescent bulb.

Figure 2:
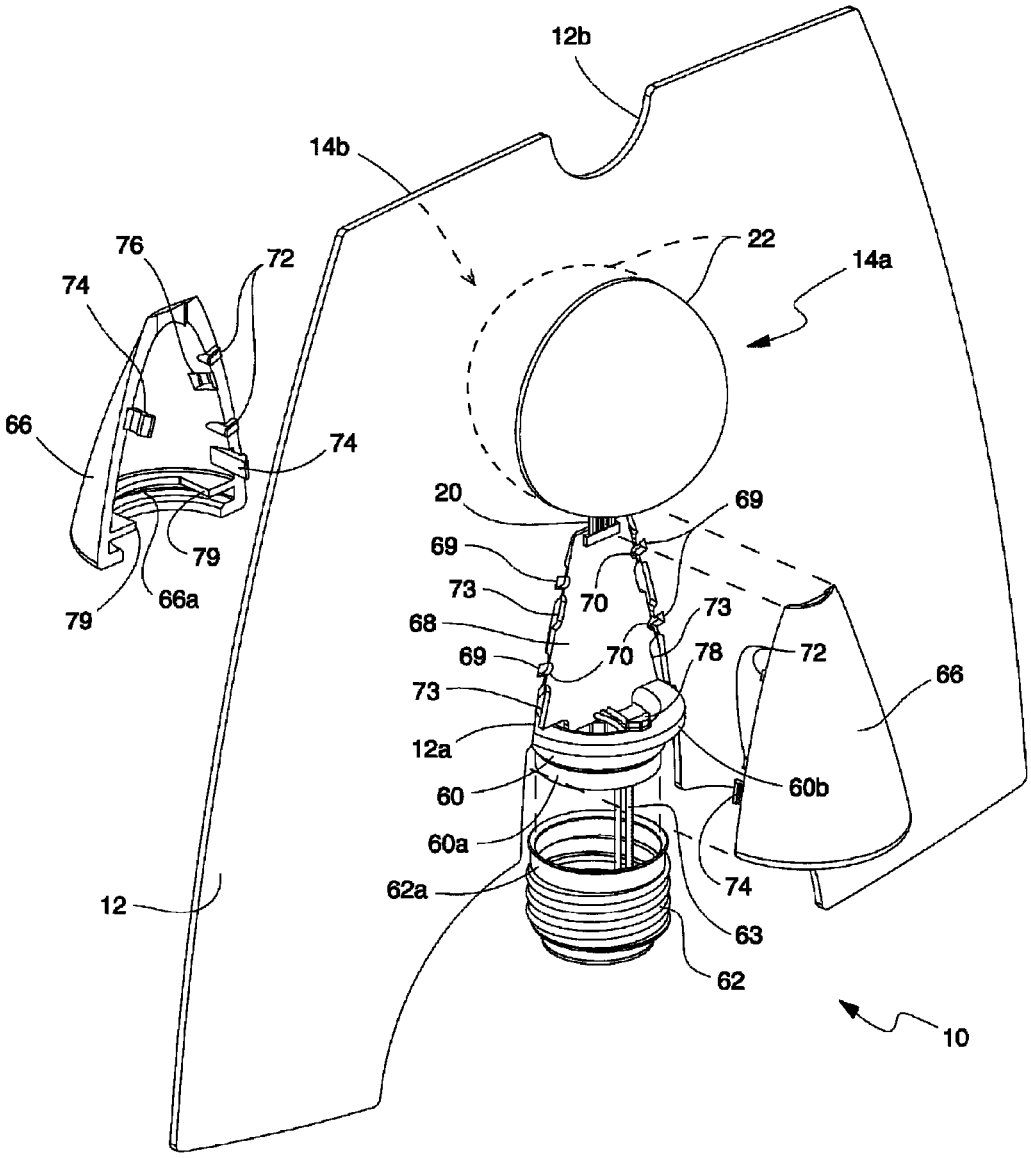
FIG. 2 is an exploded perspective view of the FIG. 1 device.
Figure 3:
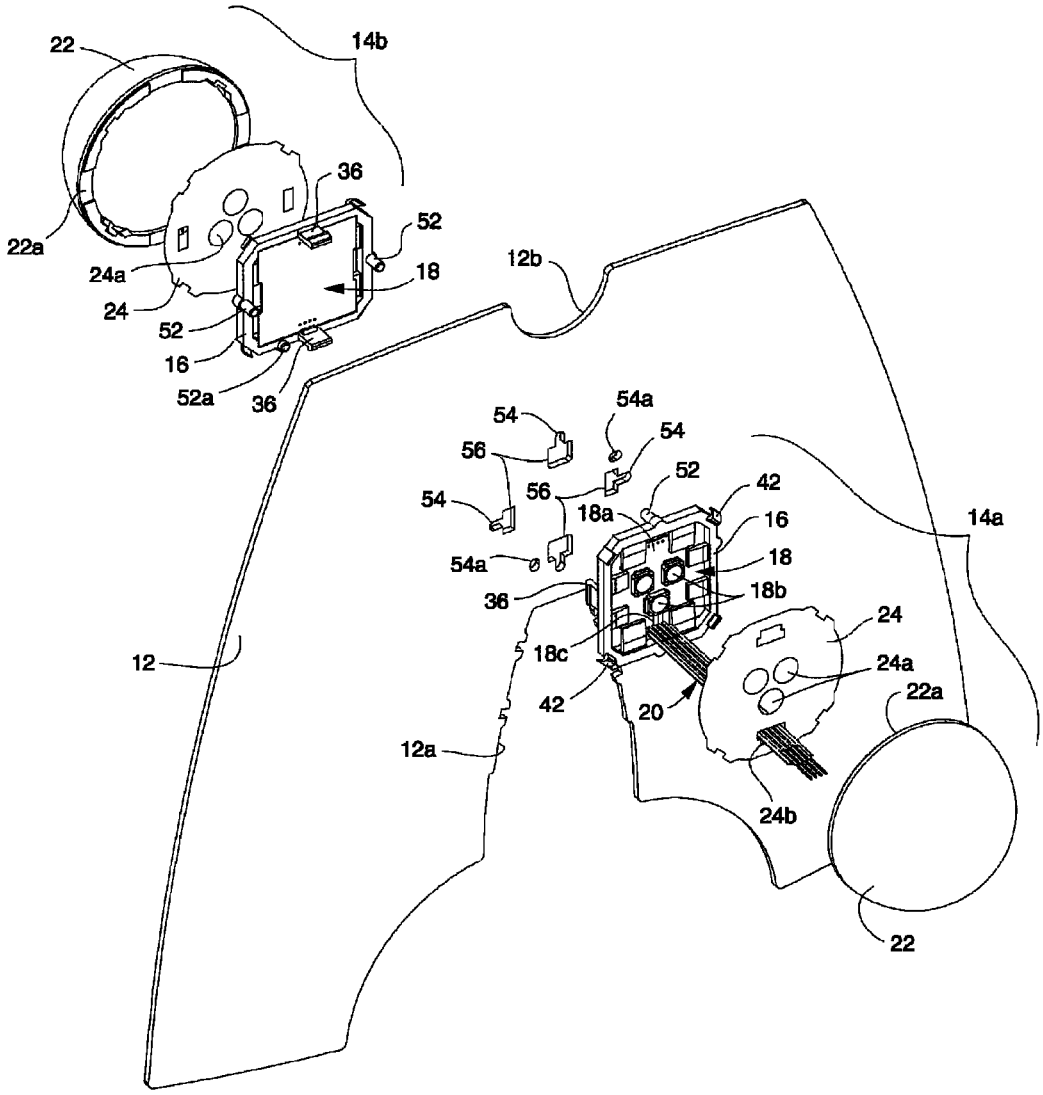
FIG. 3 is an exploded perspective view showing individual subassembly components of the FIG. 1 device.

Referring now to FIGS. 1 to 3, the bulb 10 is a component system comprising a flat, thermally conductive plate 12 which is shaped and dimensioned so that it may be centered on edge within the lampshade L so that the plate extends more or less perpendicular to harp H. The plate is formed with cutouts 12*a* and 12*b* at its bottom and top, respectively, to provide clearance for the socket S and the lampshade fastener F at the top of the harp. Positioned on opposite sides of plate 12 is a pair of minor-image subassemblies 14*a* and 14*b* which may be fixated so that they are located directly opposite one another.

Each subassembly 14*a*, 14*b* includes a mounting frame 16 which supports a PCB 18 having a plurality of LEDs 18*b* on the side of the PCB substrate 18*a* facing away from plate 12. The leads 18*c* from the LEDs on the PCB may be connected via cable 20 to a power source to be described later.

Each subassembly 14*a*, 14*b* also includes a cup-like diffuser 22 having a rim 22*a* and which engages around the frame 16 and covers the LEDs 18*b* so that the LEDs, when energized, project light through the diffuser. The diffuser may be a so-called "high dome" diffuser which is hemispherical in shape as in FIG. 2 or have a lower profile "low dome" oblate hemispherical shape as in FIG. 6.

Preferably, each subassembly 14*a*, 14*b* may also include a flat reflector 24 positioned between frame 16 and diffuser 22 which, when those components are assembled, spans the diffuser just inside rim 22*a*. Preferably, reflector 24 comprises a thin, highly reflective sheet, such as a metallized plastic film, whose reflective surface faces the diffuser. The illustrated reflector has two slots 24*b* which may provide clearance for a cable 20 when the components are assembled. Openings 24*a* are provided directly opposite LEDs 18*b* so that light from the LEDs passes through those openings and through the diffuser wall to the outside. Any light back scattered from that wall is reflected by reflector 24 back into the diffuser so that a maximum amount of light from the LEDs is transmitted through the diffuser wall to the outside.

When the two subassemblies 14*a*, 14*b* are secured at opposite sides of plate 12, the rims 22*a* of the two diffusers 22 abut those sides, thereby concealing frames 16 and their contents. Preferably, but not necessarily, cable 20 illustrated in FIG. 3 extends through one of the openings in plate 12 so that its conductors may also connect to the leads 18*c* of the other PCB 18 so that the LEDs on both PCBs are in series with a power source as will be described later.

Figure 4A:
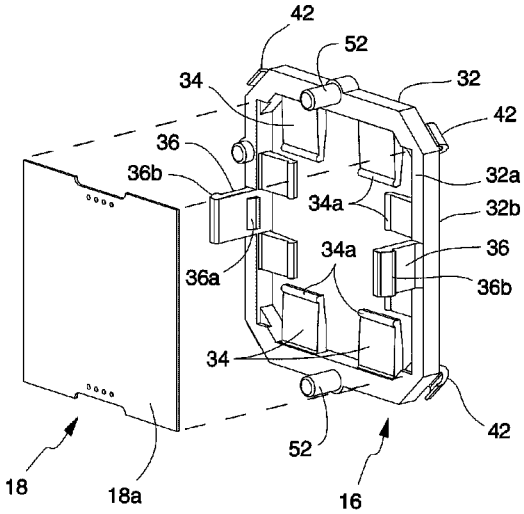
FIGS. 4A to 4F are perspective views showing the FIG. 3 components in greater detail.
Figure 4B:
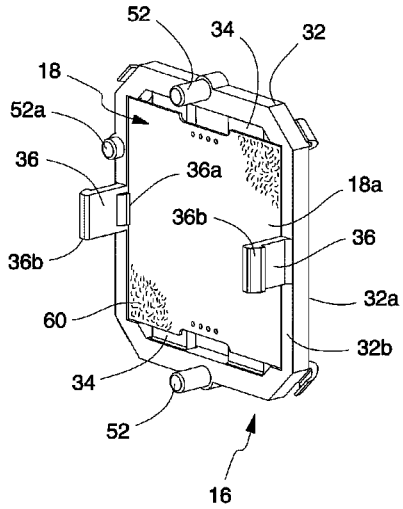

Refer now to FIGS. 4A to 4F which depict the components of each subassembly 14*a*, 14*b* in greater detail and show how they interconnect. Each mounting frame 16 comprises a generally rectangular, relatively thick ring 32 having opposite sides 32*a* and 32*b*. Extending inwardly from the ring between its sides is a plurality of flat fingers 34, each finger having a raised seating surface 34*a* at its free end on which a PCB 18 may rest. When PCB 18 is seated on fingers 34, the back side of the PCB substrate 18*a* is more or less flush with the side 32*a* of ring 36 as shown in FIG. 4B.

As best seen in FIGS. 4A and 4B, a pair of tabs 36 extend from the ring side 32*a* at opposite edges of the frame 16. The tabs 36 are formed with noses 36*a* near their roots which face toward each other so that when the PCB 18 is seated on fingers 34, the noses 36*a* overlie the back side of the PCB so as to retain the PCB against fingers 34. In other words, the tabs 36 and their noses 36*a* function as clips to secure the PCB to the corresponding frame 16.

Figure 4C:
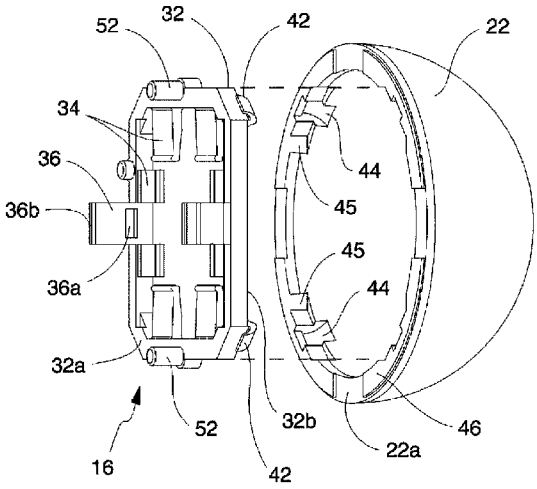
Figure 4D:
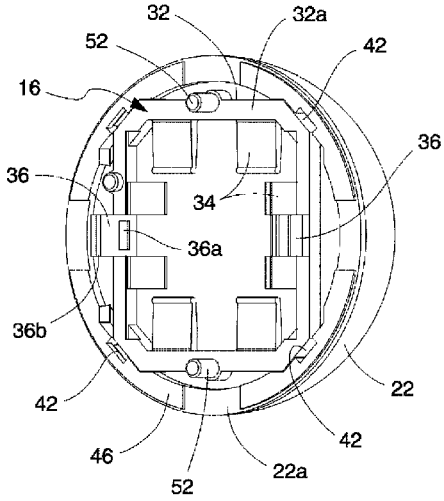

Referring now to FIGS. 4C and 4D, the frame 16 also includes devices for securing the diffuser 22 to the front side 32*b* of ring 32. More particularly, clips 42 are formed at the corners of side 32*b*. The clips extend outwardly and laterally from the ring 32, curving back on themselves to some extent. The clips 42 are adapted to engage a corresponding plurality of detents 44 formed at frame seats 45 within the diffuser 22. In other words, the detents 44 and seats 45 are set in from the diffuser rim 22*a*. Thus, when the diffuser is engaged around frame 16 such that the frame rests on seats 45, the clips 42 engage behind the detents 44 to secure the diffuser to the frame so that the diffuser rim 22*a* surrounds frame ring 32 and is flush with the ring side 32*a* as shown in FIG. 4D. While not necessary, a resilient gasket 46 may, if desired, be provided at the diffuser rim 22*a* to assure that there is no play between the diffuser 22 and the frame 16.

Figure 4E:
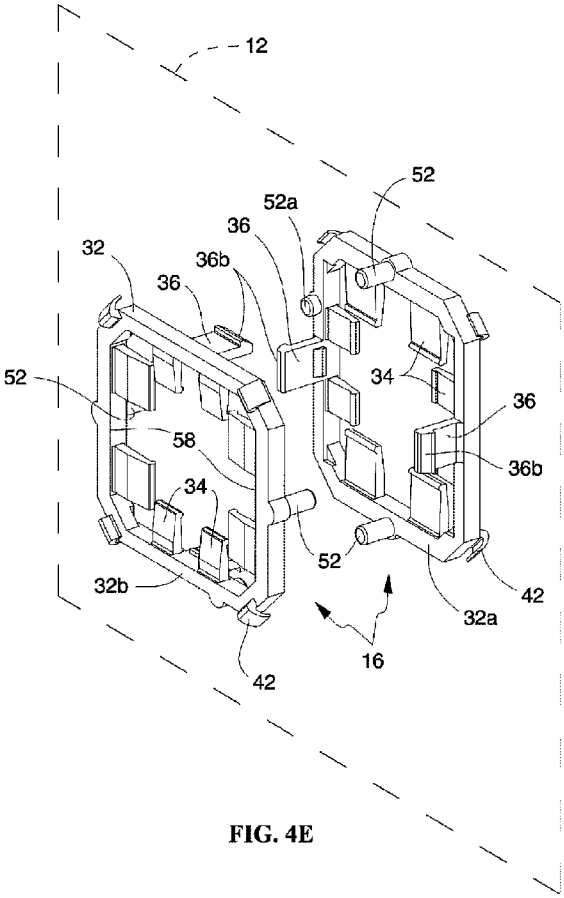

Refer now to FIGS. 3 and 4E, each frame 16 also includes a pair of locating pins 52 projecting from the side 32*a* of each mounting frame ring 32 at opposite edges of the frame. A short ancillary locating pin 52*a* may also project from side 32*a*. The locating pins 52 are adapted to project through corresponding holes 54 in plate 12 and bracket the frame on the other side of the plate to generally locate each frame 16 directly above the cutout 12*a* in the plate. The short pin 52*a* on each frame projects through a corresponding hole 54*a* in the plate to accurately fix the position of that frame relative to the plate.

Also, plate 12 is formed with openings 56 for receiving the tabs 36 of each frame 16. Each tab 36 is long enough so that it can extend through a plate opening 56 to the frame 16 at the opposite side of the plate. The end of each tab 36 is formed with an outwardly extending nose 36*b* which can engage behind a notch edge 58 in the latter frame 16. In other words, each tab 36 has a dual function in that its nose 36*a* clips a PCB 18 to the associated frame 16 and its nose 36*b* coacts with the edge 58 of the other frame to secure the two frames against plate 12.

Figure 4F:
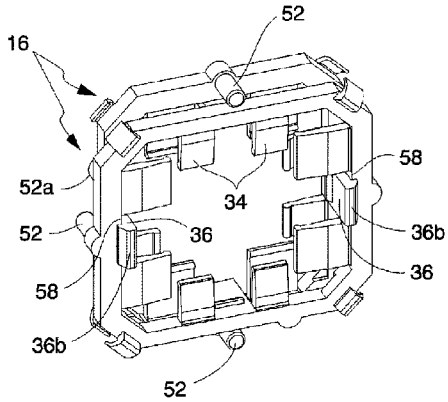

After the PCB 18 and diffuser 22 have been secured to each frame 16 as described above, the two frames 16, 16 may be positioned with their ring sides 32*a* facing plate 12 and angularly offset 90° as shown in FIG. 4E so that their respective locating pins 52, 52*a* and clips 36 can protrude through the corresponding plate holes 54, 54*a* and openings 56, respectively, in the plate 12 thereby allowing the clip noses 36*b* to interfit with the corresponding notch edges 58 of the opposite frame as shown in FIG. 4F. To accommodate the 90° angular offset of the two frames 16, 16, the plate 12 has duplicate holes 54, 54*a* and openings 56, also offset by 90° as best seen in FIG. 3. When frames 16, 16 are secured to plate 12 as just described, the back sides of the two PCBs 18, 18 are in intimate thermal contact with plate 12 which thus functions as a heat sink to conduct waste heat away from the LEDs 18*b*.

Preferably, the fingers 34 of each mounting frame 16 are flexible and resilient so that when the two frames 16, 16 are clipped together on opposite sides of plate 12, the fingers flex as necessary to accommodate tolerances in the lengths of tabs 36, while still pressing the back sides of the two PCBs 18, 18 against plate 12 to assure that intimate thermal contacts are made with the plate. We should point out also that the clipping together of the two frames 16, 16 causes the frame rings 32, 32 to bow to some extent. To account for this, the locating holes 52 and 52*a* in plate 12 are preferably slightly elongated as shown in FIG. 3.

As is well known in the art, the PCB substrate 18*a* may include thermal tunnels (not shown) under LEDs 18*b* to optimize the thermal paths between the LEDs and the plate. Preferably also, the back side of each substrate 18*a* is covered by a layer 60 of a thermally conductive adhesive as indicated by the stippling in FIG. 4B. Layer 60 may also be made to be electrically non-conductive so as to electrically isolate from plate 12 any printed leads or connections that may be present at the back side of substrate 18*a*.

Referring again to FIGS. 1 and 2, when the light source is designed as a bulb 10 for use in a lamp L, it may include a tubular mount 60 having a lower end 60*a* to which is crimped the rim 62*a* of a conductive, threaded, so-called Edison base 62 adapted to be screwed into the socket S. Of course, the base/socket connection could also be of another type, e.g. a bayonet connection. In any event, when lamp L is plugged into a standard outlet that provides 110 VAC, current flows to wires 63 connecting the contacts in base 62 to a drive circuit that is in, or associated with, bulb 10 to power the LEDs. In this event, plastic covers 66, 66 may be positioned on opposite sides of plate 12 directly below diffusers 22 to secure the mount 60 to the plate 12 and to conceal the cable 20 (FIG. 3) extending down from subassemblies 14*a*, 14*b* as well as, perhaps, a drive circuit for the LEDs.

The bulb 10 depicted in FIG. 2 does happen to include a circuit board 68 containing a drive circuit. The circuit board 68 is positioned in plate cutout 12*a* above base 62 and the drive circuit thereon is electrically connected between cable 20 and the wires 63 from base 62; see FIG. 11. As shown in FIG. 2, the walls of cutout 12*a* opposite the edges of circuit board 68 have notches 69 which are matched to minor-image notches 70 in the edges of the circuit board, the matched notches forming four keyholes. Also, one side edge of each cover 66 is formed with upper and lower keys 72. When the edges of the two covers 66, 66 are pressed against opposite sides of plate 12, their keys 72 project through the keyholes formed by notches 69 and 70 to vertically and laterally locate the mount 60, socket 62 and the circuit board 68 relative to plate 12.

Also, upper and lower openings 73 are provided at each side edge of circuit board 68. These openings provide clearance for clips 74 projecting from the side edges of covers 66, 66 so that when the covers are positioned against the opposite sides of plate 12, the clips 74 on one cover 66 are able to interfit with corresponding detents 76 on the other cover 66. Preferably the lower interior ends of covers 66, 66 are each formed with a channel 66*a* adapted to receive a flange 60*b* on mount 60 so that when the two covers 66, 66 are snapped together, the covers secure mount 60 (and base 62) to plate 12 and they also conceal that connection as well as the circuit board 68.

Referring to FIG. 2, in order to be able to center plate 12 between the legs of the harp H in FIG. 1 after bulb 10 is screwed into socket S, preferably mount 60 is rotatable within channel 66*a* to some extent, the wires 63 being long enough to allow this. A tab 78 may be provided at the top of mount flange 60*b*, positioned to engage stopping surfaces 79, 79 at the opposite ends of channel 66*a* in each cover 66 to allow a rotation of mount 60 within covers 66, 66 of up to 90°.

Figure 5:
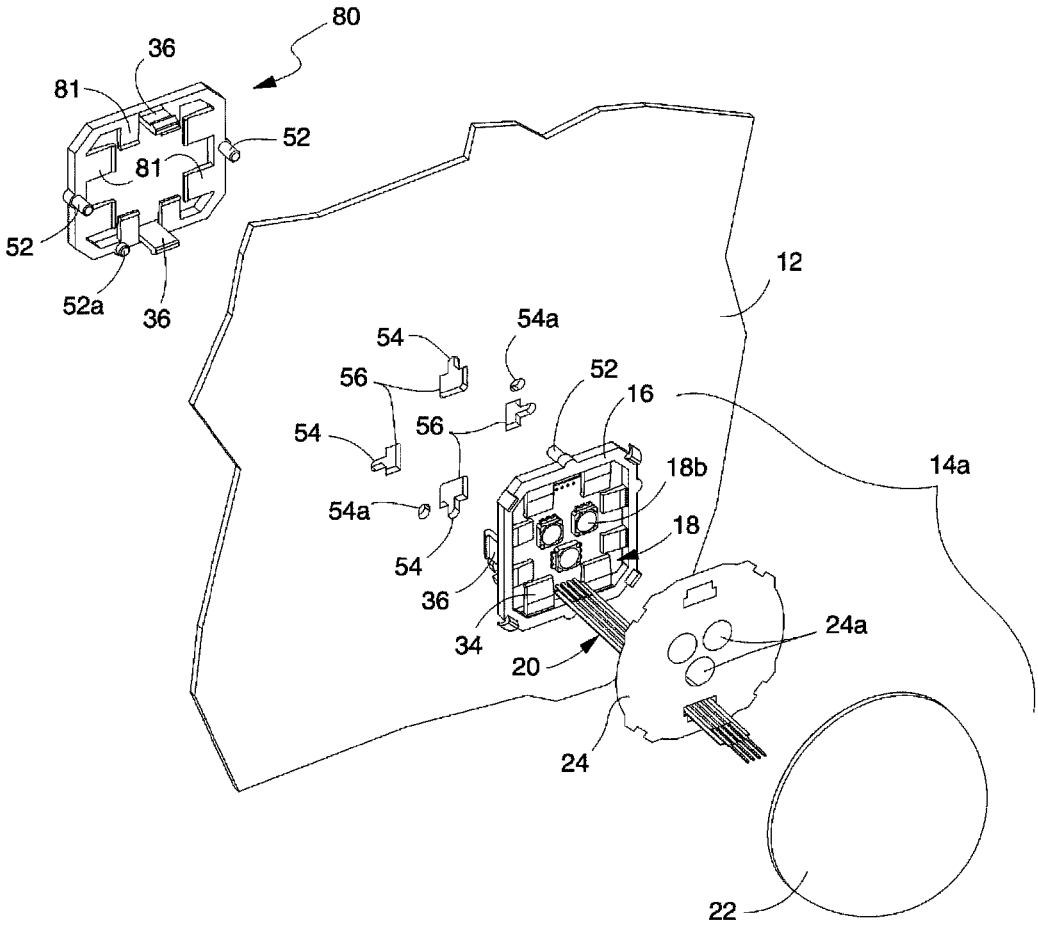
FIG. 5 is a view similar to FIG. 3 showing a single-sided lighting device embodying the invention.

Turning now to FIG. 5, in some applications, a given light source or bulb 10 may have only one subassembly 14*a* or 14*b* secured to plate 12. In this event, when a mounting frame 16 is positioned against one side of plate 12, the locating pins 52 will, as usual, project through locating holes 54 in the plate and the tabs 36 will project through the plate openings 56. The tabs may be shortened so that their noses 36*b* engage behind the edges of those openings. More preferably, a bracket shown generally at 80 in FIG. 5 may be provided with locating pins 52, 52*a* and tabs 36 substantially identical to those on a frame 16 so that the mounting frame 16 shown in FIG. 5 can be clipped to bracket 80 in the same way as it may be clipped to another bracket 16 as shown in FIG. 3. Preferably, bracket 80 also has flexible, resilient fingers 81 somewhat similar to fingers 34 of frame 16. These fingers press against plate 12 when the frame 16 and bracket 80 are clipped together to assure that the PCB 18 in frame 16 makes good thermal contact with the plate.

Figure 6:
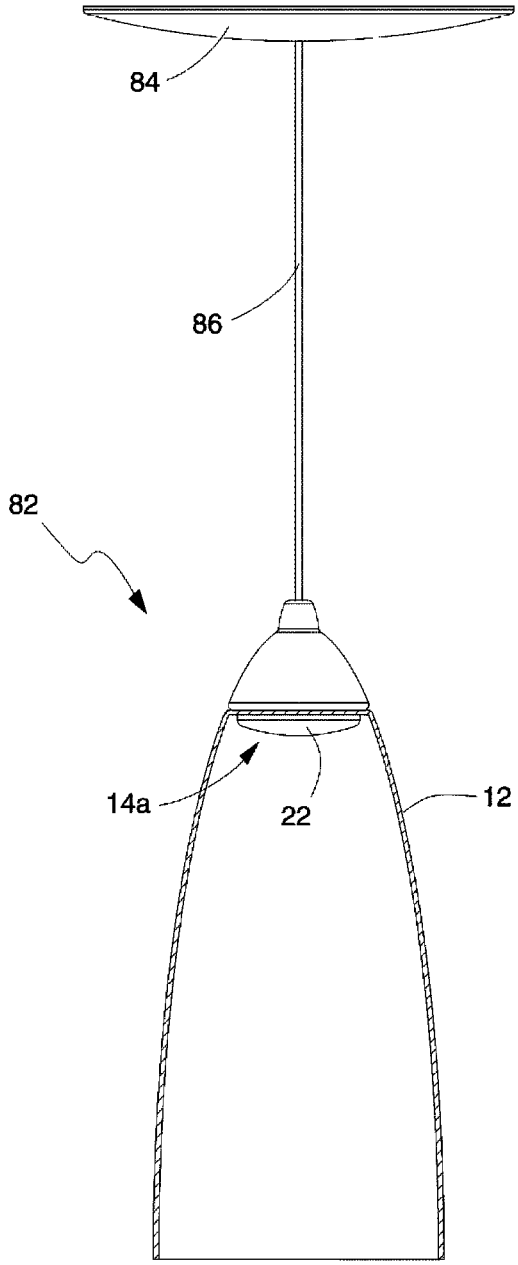
FIGS. 6 to 10 depict the lighting device incorporated into various different luminaires.

In FIG. 5, the plate 12 is shown as having a generalized shape indicating that it can be flat as illustrated in FIGS. 1 and 2 or have any other shape that is dictated by lighting or design considerations. For example, FIG. 6 illustrates a spot light pendant 82 having a single subassembly 14*a* fastened to a heat dissipating plate 12 which has a parabolic shape. In this fixture, the diffuser 22 of subassembly 14*a* is preferably of a low dome type so as to limit the re-absorption of light reflected from plate 12 back into the diffuser. The plate 12 may be conveniently suspended from a ceiling cover 84 by a tube 86 through which a cable 20 (FIG. 3) may be run. The ceiling cover may contain a drive circuit connected to the cable for powering the LEDs in subassembly 14*a*.

Figure 7:
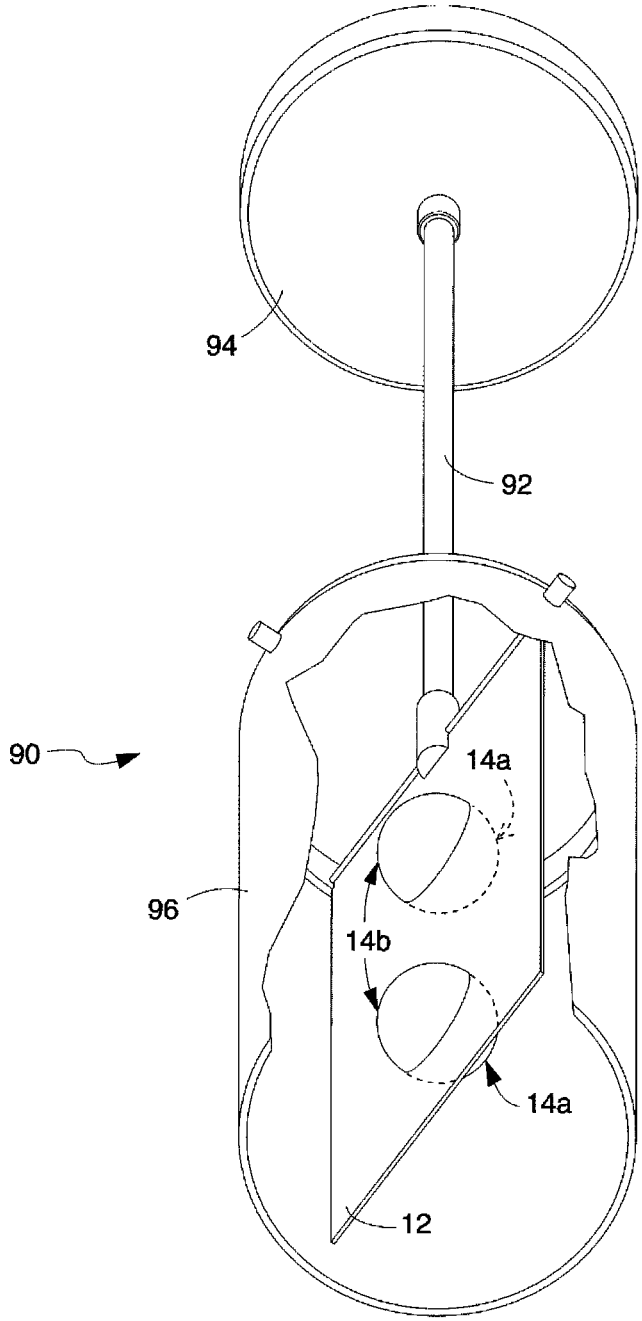

FIG. 7 shows another ceiling pendant indicated generally at 90 which includes subassemblies 14*a*, 14*b* on opposite sides of a plate 12 at upper and lower positions on the plate. In this case, the cable of each subassembly extends through a pendant suspension tube 92 to a ceiling cover 94 that may contain a drive circuit for powering the LEDs in the four subassemblies. Preferably, a translucent or transparent sleeve 96 encircles plate 12 and the subassemblies supported thereby.

Figure 8:
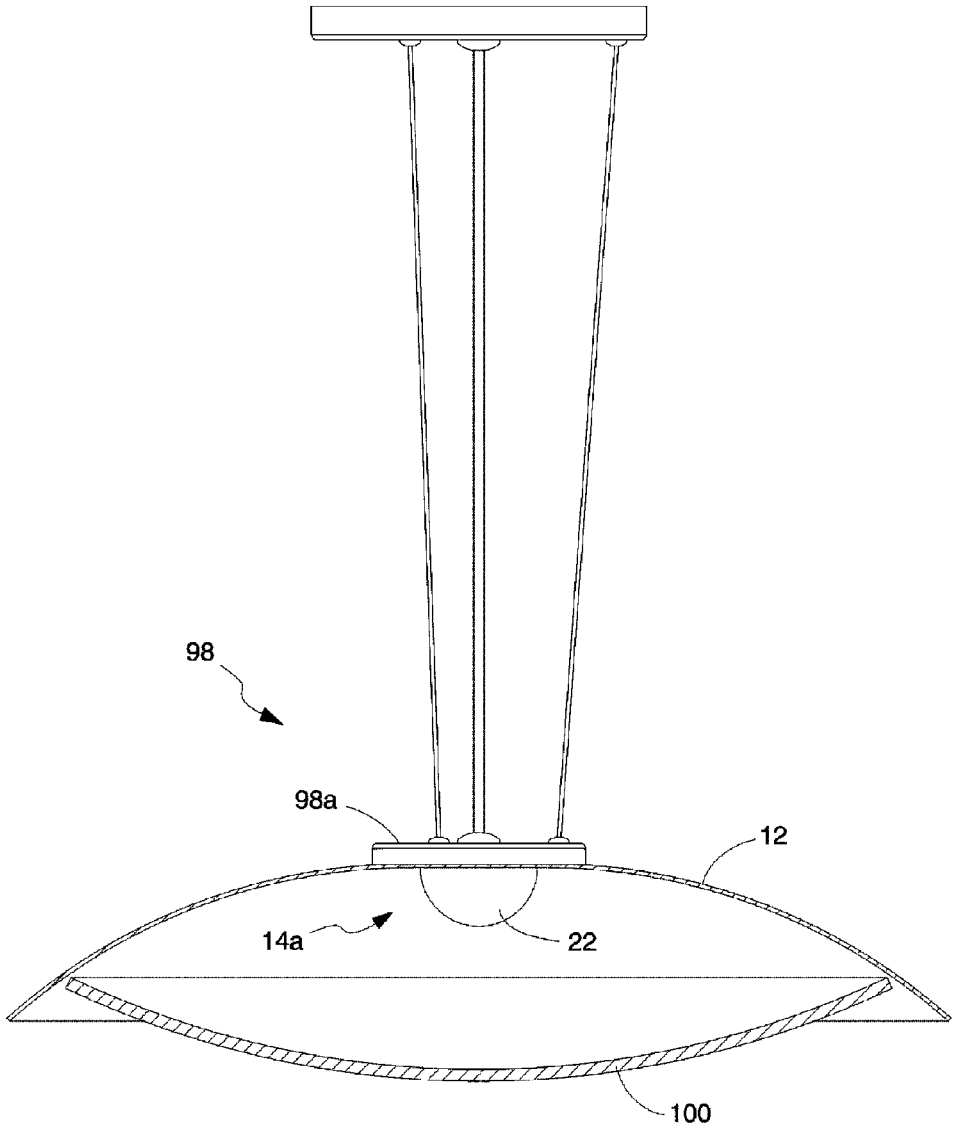

Refer now to FIG. 8 which depicts an area light pendant shown generally at 98 incorporating a single subassembly 14*a* having a high dome diffuser 22 and secured to a plate 12. The plate functions not only as a heat sink but also as a curved reflector which directs the light from subassembly 14*a* downward through a secondary diffuser 100 secured to plate 12. The pendant 98 may be suspended via its housing 98*a* from the ceiling and powered in the same manner as the previous pendants.

Figure 9:
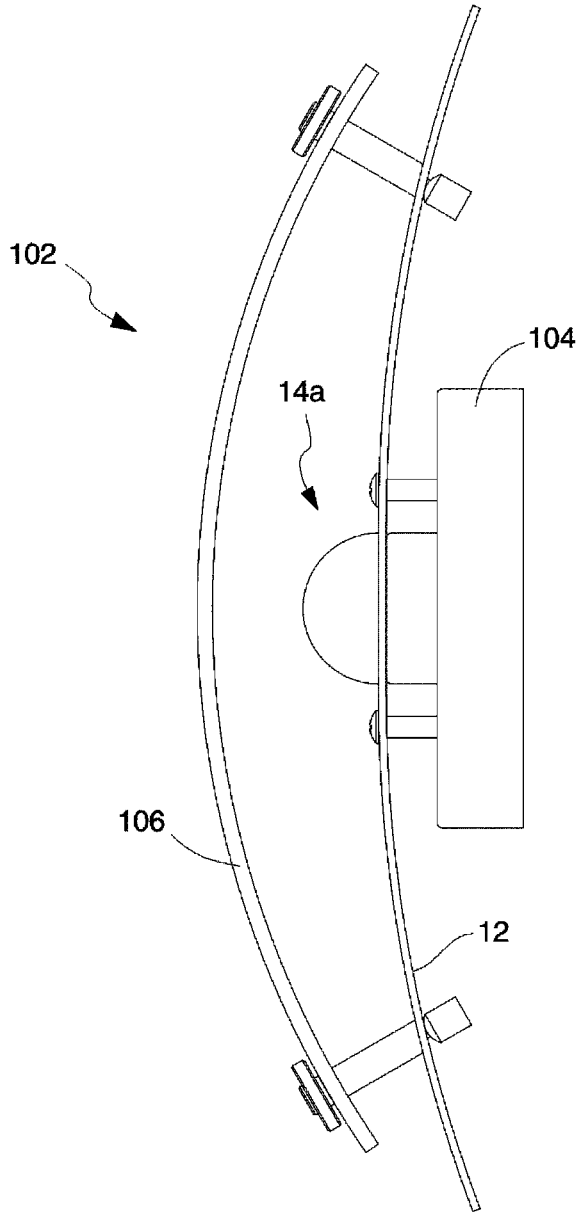

FIG. 9 shows another light source in the form of a wall fixture or luminaire 102 wherein a single subassembly 14*a* is mounted to an outwardly bowed plate 12. In this case, plate 12 is secured to a wall cap 104 at the back of the plate and the light from the subassembly 14*a* is directed through a secondary diffuser 106 mounted to the front of the plate.

Figure 10:
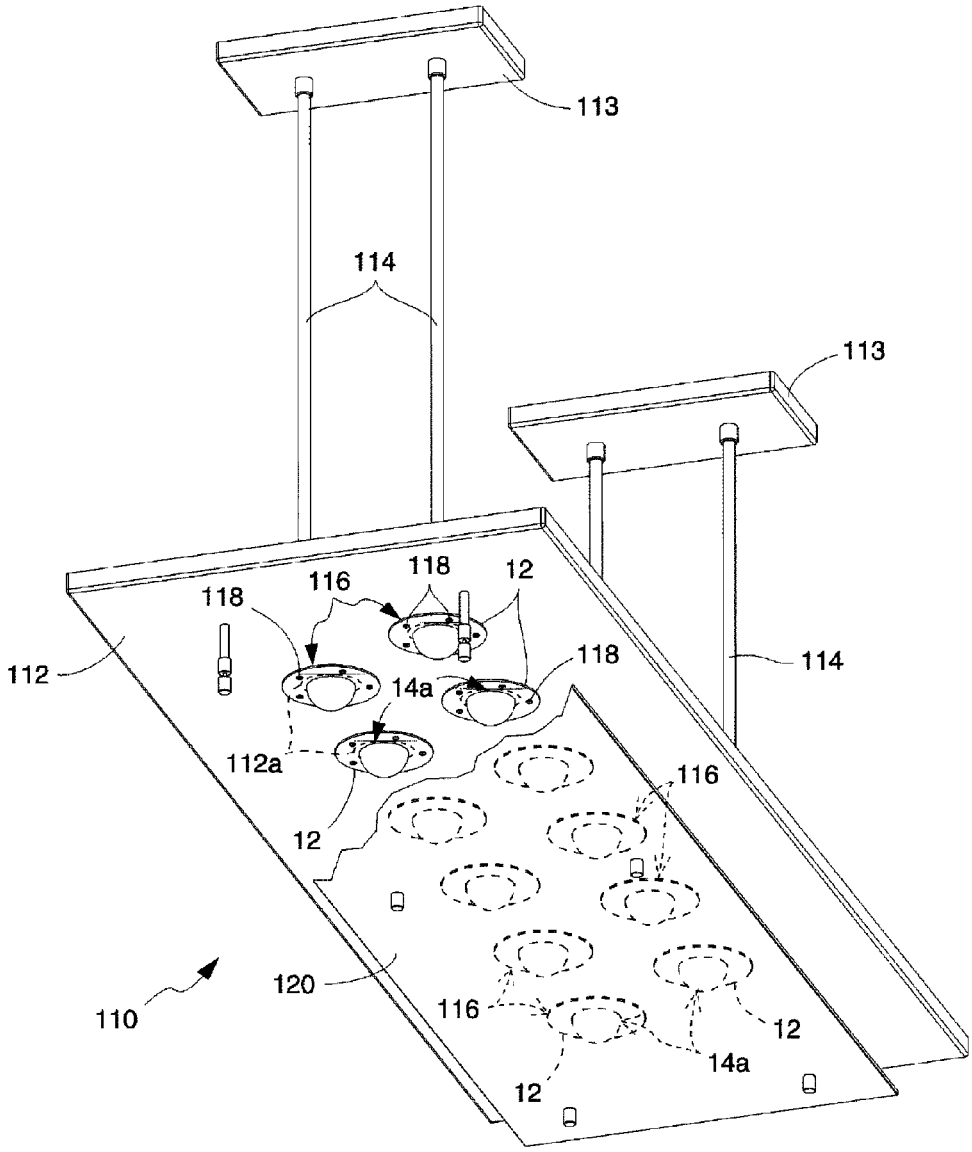

Turn now to FIG. 10 which shows a modular ceiling fixture 110 incorporating the invention. In this case, the fixture includes a large, rigid metal sheet 112 which may be suspended from ceiling covers 113 by tubes 114. The sheet 112 is formed with rows of openings 112*a* for receiving modules 116, each of which includes a subassembly 14*a* fastened to a small plate 12. The plate 12 of each module 116 is releasably secured by suitable fasteners 118 to sheet 112 over an opening 112*a* so that there is intimate thermal contact between each small plate 12 and the large sheet 112. Preferably, a translucent sheet 120 is suspended from sheet 112 to further diffuse, the light from all the modules 116 in the fixture 110.

The cables 20 (FIG. 3) from the various modules 116 may be coupled to a harness or bus (not shown) leading to a drive circuit in one of the covers 113 to power the LEDs in the modules. Thus, in this embodiment, if one module 116 fails, it can be replaced easily without effecting the other modules simply by separating its plate 12 from sheet 112 and disconnecting its cable 20 from the bus.

While all the LEDs 18*b* in subassemblies 14*a*, 14*b* may be the same in a given bulb 10 or other lighting fixture, more preferably they are divided into groups having different color temperatures with the different groups being separately controllable to vary the overall color temperature of the lighting device at different light intensity levels. This is because, although light from the same LEDs may be dimmed by reducing the drive current to those LEDs, such dimming does not result in the familiar color temperature change associated with conventional incandescent light sources.

Figure 11:
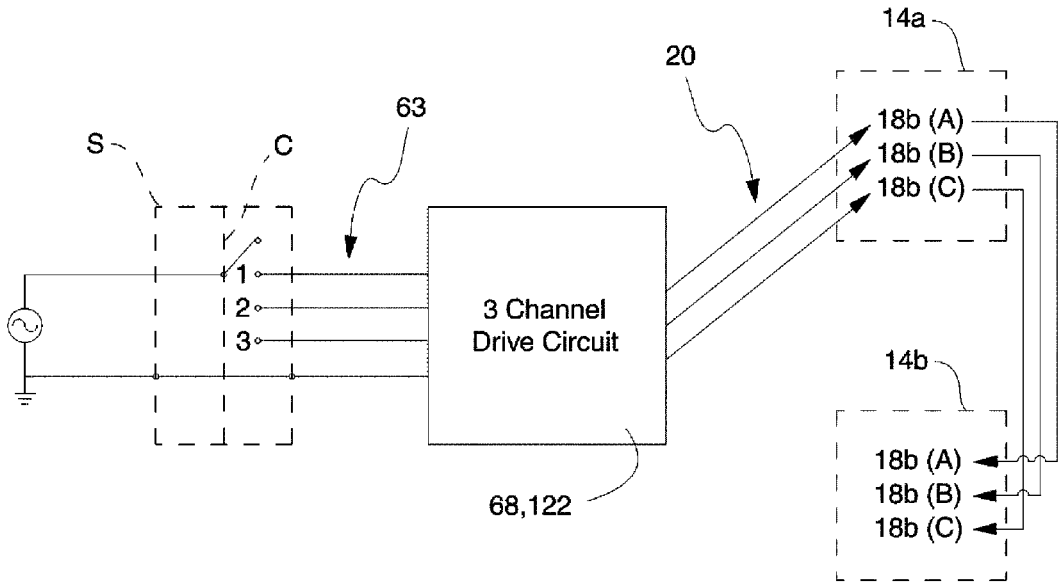
FIG. 11 is a block diagram showing a drive circuit for powering the lighting device.

Thus, for example, the three LEDs 18 in each subassembly 14*a*, 14*b* depicted in FIGS. 3 and 5 may have three different color temperatures A, B and C, respectively. The particular number of LEDs in each subassembly and the particular mix of color temperatures may vary depending on the desired lighting effect. Thus, each of A, B and C may represent the combined or net color temperature from a group of different LEDs. The LEDs in each group may be connected in series via separate leads or channels in cable(s) 20 to a three-channel drive circuit 122 powered, for example, by a 110 VAC, 60 Hz household power source as shown in FIG. 11. The drive circuit 122 may be on a circuit board located in the bulb 10 between covers 66 as shown at 68 in FIG. 2 in which case socket S may be a standard three-way socket, switched by control C to selectively deliver current to the three channels of drive circuit 122. Each channel services a different one of the LED groups A-C in subassemblies 14*a* and 14*b*, delivering 6-7 VDC to the LEDs. The drive circuit could also be located in the base of lamp L and, in the case of the fixtures shown in FIGS. 6-10, behind the ceiling or wall covers of those fixtures, and controlled by a wall switch.

Of course, one or two groups of LEDs 18*b* may be controlled by a one or two-way switch. In fact, the different color temperature LEDs 18*b* may even be dimmed in a continuous manner by a drive circuit such as the one described in U.S. Pat. No. 7,288,902, the contents of which are hereby incorporated herein by reference.

In any event, it is evident from FIG. 11 that the switched socket S is able to activate different LEDs 18 in subassemblies 14*a*, 14*b* at each ON position (1, 2 & 3) of switch control C so that the lighting device may produce light having different color temperatures at three intensity levels to emulate the lighting from a standard three-way incandescent bulb.

It will thus be seen that the objects set forth above among those made apparent from the preceding description are efficiently attained. Also, certain changes may be made in the constructions set forth without departing from the scope of the invention. For example, in some applications, to conceal cable 20, a bulb 10 may have two identical plates 12 sandwiched together with the cable extending between them. A thermally conductive adhesive may be utilized to bond the plates together. Therefore, it is intended that all matter contained in the above description or shown in the accompanying drawings shall be interpreted as illustrative and not in a limiting sense.

It is also to be understood that the following claims are intended to cover all of the generic and specific features of the invention described herein.

The invention claimed is:

1. A solid state lighting device comprising a relatively rigid, thermally conductive, reflective plate having opposite sides;

a mounting frame having opposite first and second sides and an open center;

a printed circuit board with front and back sides and a plurality of LEDs mounted to the front side, the back side of the board being substantially flat, said board being supported by the frame so that the back side of the board is more or less flush with the first side of the frame and the LEDs are opposite said open center;

a cup-like light diffuser having a rim engaged over the second side of the mounting frame so that the diffuser surrounds the frame and covers the LEDs, said frame, printed circuit board and diffuser constituting a first subassembly, and fastening devices for fastening the first subassembly against one side of the plate so that said back side of the board is pressed against the plate and the diffuser rim abuts the plate, whereby when the LEDs are energized, a maximum amount of light from the LEDs is directed through the diffuser and waste heat from the LEDs is efficiently conducted away by the plate.

2. The device defined in claim 1 and further including a reflector positioned opposite the second side of the frame, the reflector having a reflective surface facing the diffuser and one or more light-transmitting windows opposite the LEDs to allow light from the LEDs to shine therethrough into the diffuser.

3. The device defined in claim 2 wherein the reflector is a metallized plastic film.

4. The device defined in claim 1 and further including a thermally conductive layer sandwiched between said back side of the board and the plate.

5. The device defined in claim 4 wherein said layer is an electrically insulating adhesive layer.

6. The device defined in claim 1 wherein the diffuser is substantially hemispherical in shape.

7. The device defined in claim 1 wherein the diffuser has the general shape of an oblate hemisphere.

8. The device defined in claim 1 wherein said frame includes a plurality of flexible resilient fingers extending from between said sides of the frame towards said open center and on which said one side of the substrate is seated, and a plurality of clips extending from the frame that engage the board, thereby securing the board to the frame.

9. The device defined in claim 1 wherein the fastening devices include a plurality of clips projecting from said first side of the frame, and a corresponding plurality of openings in the plate for receiving the clips.

10. The device defined in claim 9 and further including a plurality of locating pins projecting from the first side of the frame, and a corresponding plurality of locating holes in the plate for snugly receiving different ones of said locating pins.

11. The device defined in claim 9 wherein the fastening devices include a bracket positioned against the other side of the plate, said bracket being formed with a plurality of detents and said clips being dimensioned to engage the detents so that the plate is clamped between the frame and the bracket.

12. The device defined in claim 1 and further including a second subassembly substantially identical to the first subassembly, and second fastening devices for fastening the second subassembly against the other side of the plate.

13. The device defined in claim 12 wherein the plate has openings, and the first and second fastening devices include a plurality of clips projecting from the first side of each frame through selected different ones of said openings and engaging a corresponding plurality of detents on the other frame so that the plate is clamped between said first and second subassemblies.

14. The device defined in claim 13 and further including a plurality of locating pins projecting from the first side of the frame in each subassembly, and a plurality of locating holes in the plate for snugly receiving different ones of said plurality of locating pins.

15. The device defined in claim 14 wherein the first and second frames are angularly offset from one another about an axis perpendicular to the plate.

16. The device defined in claim 1 wherein the plate is flat.

17. The device defined in claim 1 wherein the plate is curved with sides which surround the frame and extend beyond the diffuser.

18. The device defined in claim 1 wherein the plate is comprised of a pair of similar superimposed plate layers.

19. The device defined in claim 1 wherein the plurality of LEDs include LED groups having different color temperatures, and further including a plural channel drive circuit connected to said LEDs for separately controlling the different LED groups.

20. A lighting fixture comprising:

a rigid, thermally conductive sheet having a plurality of openings;

a corresponding plurality of lighting devices as defined in claim 1, whose plates are designed and dimensioned to engage over and cover different ones of said openings;

securing devices for releasably securing each of said plates to the sheet so that the plates are in intimate thermal contact with the sheet;

an electrical bus for connection to a power source, and electrical couplings for releasably electrically connecting the LEDs of each of said lighting devices separately to the bus so that a failed one of said lighting devices can be removed easily from the fixture and replaced without disturbing the remaining lighting devices.

21. The fixture defined in claim 20 and further including a drive circuit connected to the bus for supplying relatively low voltage direct current to the LEDs in all said lighting devices.

22. A solid state light source comprising a relatively rigid, thermally conductive plate having opposite sides;

a pair of similar subassemblies mounted in opposition at the opposite sides of said plate, each subassembly including a circuit board with front and back sides and at least one LED mounted to the front side, the back side of the board being substantially flat and secured to the adjacent side of the plate so that said back side is in intimate thermal contact with the plate whereby any heat from the at least one LED is conducted away by the plate, and a cup-like light diffuser having a rim secured to the adjacent side of the plate so that the diffuser substantially covers the at least one LED whereby light from the at least one LED radiates into the diffuser;

a base with a plurality of electrical contacts and adapted to be coupled to a lamp socket to establish electric connections therewith;

mounting structure for mounting the base to the plate so that the base is substantially parallel to the plate, and an electrical connection device connecting the LED to the at least one electrical contacts in the base.

23. The light source defined in claim 22 and further including a drive circuit connected electrically to the contacts in the base for converting AC current from a power source to a lower voltage direct current for driving the at least one LED.

24. The light source defined in claim 23 wherein the drive circuit constitutes part of the electrical connection device between the at least one LED and the contacts in the base.

25. The light source defined in claim 23 wherein the at least one LED comprises a plurality of LEDs arranged in LED groups having different color temperatures, and the drive circuit has separate channels enabling separate control of the LED groups.

26. The light source defined in claim 22 wherein the mounting structure comprises a pair of covers for positioning on opposite sides of the plate and base, said covers having surfaces which interfit with the plate and base as well as with each other to secure all those components together.

27. The light source defined in claim 22 wherein the plate is composed of a pair of substantially identical superimposed plate layers.

28. The light source defined in claim 22 wherein the back side of the circuit board and the diffuser rim are secured to the plate by a mounting frame having an open center.

29. The light source defined in claim 22 wherein said at least one LED comprises a plurality of LEDs.

30. A solid state lighting device comprising a relatively rigid, thermally conductive, reflective plate having opposite sides;

a printed circuit board with front and back sides and a plurality of at least one LEDs mounted to the front side, the back side of the board being substantially flat;

a cup-like diffuser having a rim, said board and said rim being secured to one side of the plate so that the back side of the board is in intimate thermal contact with the plate and the diffuser substantially covers the LEDs whereby when the LEDs are is energized, a maximum amount of light therefrom radiates is directed into the diffuser and waste heat from the LEDs is efficiently conducted away by the plate, said circuit board and diffuser constituted a first subassembly;

a fastening device for fastening the first subassembly against said one side of said plate;

a second subassembly substantially identical to the first subassembly, and a second fastening device for fastening the second subassembly against the other side of said plate.

* * * * *

UNITED STATES PATENT AND TRADEMARK OFFICE

CERTIFICATE OF CORRECTION

PATENT NO. : 8,414,147 B2
APPLICATION NO. : 12/785602
DATED : April 9, 2013
INVENTOR(S) : John E. Thrailkill It is certified that error appears in the above-identified patent and that said Letters Patent is hereby corrected as shown below:

In the Specifications:

In col. 3, line 58 should read:
12 is a pair of ~~minor~~mirror-image subassemblies 14*a* and 14*b* which In col. 6, line 5 should read:
board 68 have notches 69 which are matched to ~~minor~~mirror-image In the Claims In col. 11, line 12 should read:
diffuser ~~constituted~~ constituting a first subassembly;

Signed and Sealed this
Second Day of July, 2013

Teresa Stanek Rea
*Acting Director of the United States Patent and Trademark Office*